United States Patent [19]

Bockwinkel et al.

[11] Patent Number: 4,459,788

[45] Date of Patent: Jul. 17, 1984

[54] PLYWOOD-BACKED DOUBLE COURSE SHINGLE PANEL

[75] Inventors: Joe L. Bockwinkel, Winlock; Willis G. Pehl, Chehalis, both of Wash.

[73] Assignee: Shakertown Corporation, Winlock, Wash.

[21] Appl. No.: 280,719

[22] Filed: Jul. 6, 1981

Related U.S. Application Data

[63] Continuation-in-part of Ser. No. 238,274, Feb. 25, 1981, abandoned.

[51] Int. Cl.[3] ..... E04D 1/20

[52] U.S. Cl. ..... 52/535; 52/540; 52/541; 52/748; 156/71

[58] Field of Search ..... 52/519, 541, 748, 540, 52/560, 551, 553, 535; 29/432, 469; 144/329, 359, 353, 344, 363; 156/71

[56] References Cited

U.S. PATENT DOCUMENTS

| | | | |
|---|---|---|---|
| Re. 27,502 | 10/1972 | Martin | 52/94 |
| 337,310 | 3/1886 | Crabbe | 52/535 |
| 2,232,075 | 2/1941 | Nevin | 52/540 |
| 2,384,686 | 9/1945 | Kraus | 52/409 |
| 2,592,244 | 4/1952 | Chamerlain | 52/541 |
| 2,727,283 | 12/1955 | Gollner | 52/553 |

*Primary Examiner*—John Edward Murtagh

*Attorney, Agent, or Firm*—Robert W. Beach; Ward Brown

[57] ABSTRACT

A wood shingle panel includes an elongated backing sheet and a face layer adhesively bonded together, the face layer being composed of a double course of half-length shingle sections formed by severing standard full-length tapered wood shingles midway between their tip and butt ends. The butt end portions of the tip shingle sections are located adjacent to the lower longitudinal edge of the backing sheet and the tip end portions of the butt shingle sections are located adjacent to the upper longitudinal edge of the backing sheet. The butt end portions of the butt shingle sections are arranged along the central portion of the backing sheet and overlie the tip end portions of the tip shingle sections. The butt end portions of the butt shingle sections are rabbeted for receiving the tip end portions of the tip shingle sections in the rabbet. The lower margin of the backing sheet may be rabbeted beneath the butt portions of the tip shingle sections to overlap the upper margin of the next lower panel.

18 Claims, 11 Drawing Figures

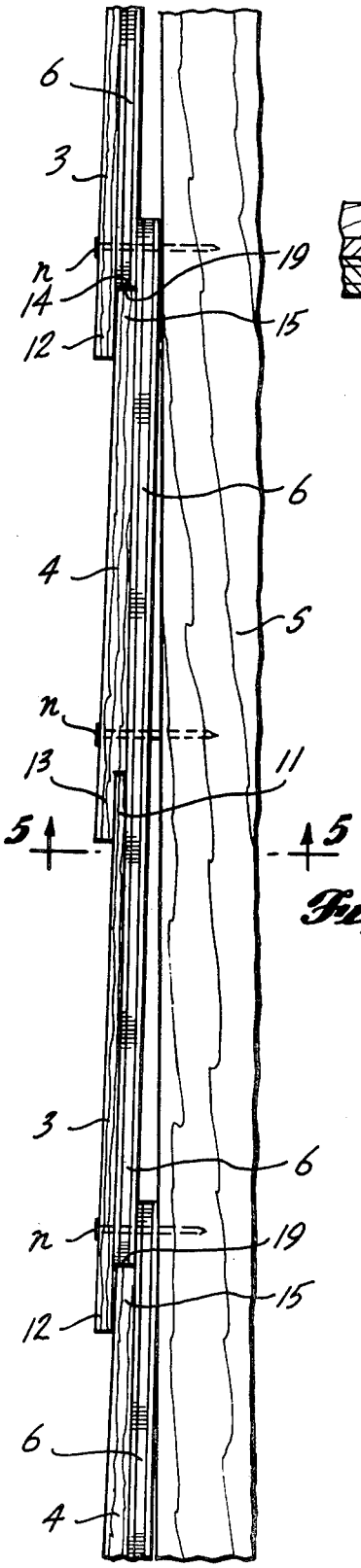
Fig. 4.
Fig. 5.
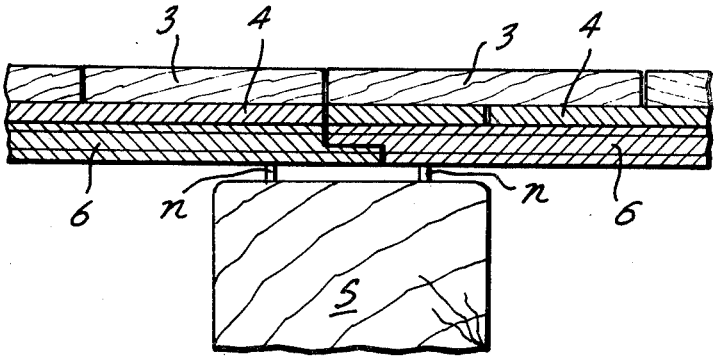

PLYWOOD-BACKED DOUBLE COURSE SHINGLE PANEL

CROSS REFERENCE

This is a continuation-in-part of application Ser. No. 238,274, filed Feb. 25, 1981, for Plywood-Backed Double Course Shingle Panel which was abandoned.

BACKGROUND OF THE INVENTION

1. Field of the Invention

The present invention relates to shingle panels and a method of manufacturing the panels. More particularly, it relates to the manufacture of colonial or standard exposure wood shingle panels with face upper and lower course of half-length shingle sections formed from full-length sawn shingles mounted on a backing sheet, preferably of plywood, and shingle panels in which one edge portion of the backing sheet is routed to form a rabbet for overlapping and aligning successive courses of shingle panels.

2. Prior Art

No known prior art colonial or standard exposure shingle panel has face upper and lower courses of half-length shingle sections with no intervening face course of shingles or shingle sections, which shingle sections have been produced by severing full-length shingles midway between their butt and tip ends. In the past colonial or standard 7 to 8 inch (17.8 to 20.3 cm) exposure shingle-surfaced roofing and siding have been created by overlapping courses of full-length 16 inch (40.6 cm) shingles or 18 inch (45.7 cm) shingles. In such an arrangement less than one-half of the length of each shingle is exposed.

An example of a prior art colonial shingle panel having a double course of shingles is disclosed in Kraus U.S. Pat. No. 2,384,686. However as shown in FIG. 1, the Kraus panel comprises a course of full-length conventional tapered wood shingles and a course of butt shingle sectons overlying the upper or tip portions of the full-length shingles.

Also no known prior art shingle panel has a backing sheet which has a portion of the lower edge routed to form a rabbet for overlapping and aligning successive panels. While the Martin reissue U.S. Pat. No. 27,502 discloses a panel assembly which includes a rabbet for overlapping and aligning successive panels, such rabbet is formed by laying up the panel assembly with the surfacing material overhanging the lower edge of a full-thickness backing sheet, rather than the backing sheet being routed to form a rabbet as in the present invention. By a lower margin of a backing sheet overlapping the surface material of the next lower course of panels, rain penetration is prevented, whereas in the Martin paneling rain can penetrate between the shingles near the lower margin of the panel and seep between the lower edge of the upper backing sheet and the upper edge of the backing sheet in the next lower course of panels.

SUMMARY OF THE INVENTION

For the purpose of the present invention, the word "shingle" is used to designate a small thin piece of wood usually approximately 16 inches (40.6 cm) or 18 inches (45.7 cm) in length and of random width, generally within the range of 2 inches (5.1 cm) to 12 inches (30.5 cm) which is sawn with a taper from butt to tip. Alternatively, such shingles could be resawn from uniform thickness split boards to provide flat backs and rustic split faces.

It is the principal object of the present invention to provide a colonial or standard exposure shingle panel, i.e. 7 inch (17.8 cm) or 8 inch (20.3 cm) exposure, which does not require a substantially greater amount of shingle material than for a 14 inch (35.6 cm) or 16 inch (40.6 cm) exposure when using standard 16 inch (40.6 cm) or 18 inch (45.7 cm) shingles while retaining the appearance of colonial exposure shingling and the weather resistance of standard shingling.

Another object is to provide a shingle panel with improved resistance to rain penetration between successive courses of the shingle panels.

A further object is to produce such a shingle panel which is economical and easy to manufacture, and which can be applied to a roof or sidewall quickly and easily.

Some of the foregoing objects can be accomplished by a shingle panel including a backing sheet and a face layer composed of face upper and lower courses of half-length shingle sections formed by severing standard full-length shingles midway between their tip and butt ends. The butt end portions of the butt shingle sections forming the face upper shingle course are rabbeted and overlie the tip end portions of the tip shingle sections forming the face lower course in the single panel.

Others of the foregoing objects can be accomplished by a shingle panel including a backing sheet having a rabbeted lower margin which overlies the tip end portions of the butt shingle sections of the next lower course of shingle panels.

BRIEF DESCRIPTION OF THE DRAWINGS

FIG. 4 is a vertical section of panels of the type shown in FIG. 2 applied to a sidewall, parts being broken away.

FIG. 5 is a horizontal section taken along line 5—5 in FIG. 4.

DETAILED DESCRIPTION

Figure 1:
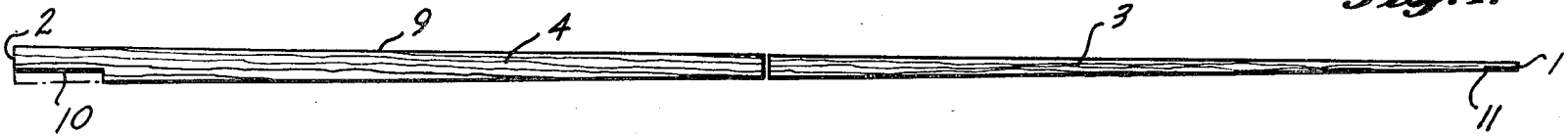
FIG. 1 is a side elevation of a standard full-length shingle which has been severed midway between its butt and tip ends and has had the lower side of its butt margin rabbeted.
Figure 2:
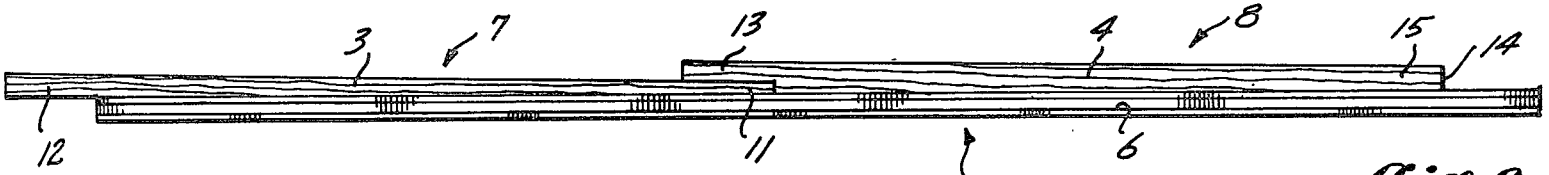
FIG. 2 is a side elevation of a shingle panel having a face lower course formed by tip shingle sections and a face upper course formed by butt shingle sections of FIG. 1.
Figure 3:
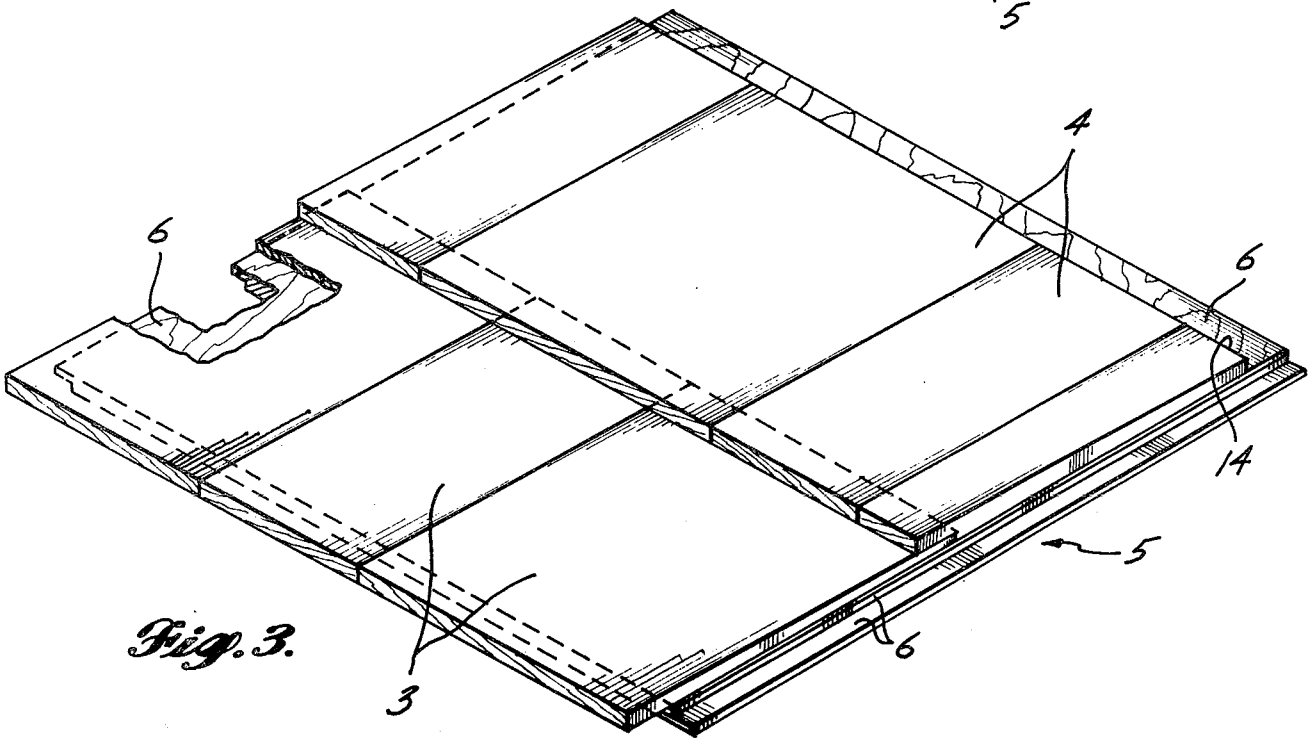
FIG. 3 is a top perspective of the FIG. 2 shingle panel with parts broken away.

To make a shingle panel which can be used to construct a weather surface that resembles a colonial or standard exposure shingle surface and deters rain penetration while using a minimum amount of expensive wood shingle material, such as red cedar, full-length, 16 inch (40.6 cm) or 18 inch (45.7 cm), clear, usually edge grain, shingles are severed transversely between their tip ends 1 and butt ends 2 forming half-length tip shingle sections 3 and half-length butt shingle sections 4 as shown in FIG. 1. The shingle panel 5 shown in FIGS. 2 and 3 is formed by laying up an elongated backing sheet 6 of plywood or flakeboard and a face layer composed of a face lower course 7 of tip shingle sections 3 adjacent to the lower longitudinal edge of the backing sheet and a face upper course 8 of butt shingle sections 4 adjacent to the upper longitudinal edge of such sheet with no face course of shingles or shingle sections interposed between such face lower and upper courses of shingle sections. The backing sheet may, for example, be 4 feet (1.2 meters) or 8 feet (2.4 meters) in length and is of a width nearly as great as the combined lengths of the face tip shingle sections 3 and the face butt shingle sections 4.

As shown by a comparison of FIG. 1 and FIG. 2, the lengthwise relationship of each face butt shingle section 4 and of each face shingle section 3 in the panel lay-up is interchanged from the lengthwise relationship of such sections in the full-length shingle of FIG. 1. In the panel lay-up, therefore, the tip end portion of each face tip shingle section 3 is disposed adjacent to the butt end portion of a face butt shingle section 4 approximately midway between the longitudinal edges of the backing sheet.

The butt end portion of the full-length shingle is routed opposite the face or exposed surface 9 prior to or simultaneously with the shingle-severing operation, or the butt end portion of the butt shingle section 4 may be routed after being severed from the full-length shingle, forming the rabbet 10. The depth of the rabbet is approximately equal to the thickness of the tip end portion 11 of the tip shingle section 3 and the width of the rabbet is preferably about one inch (2.54 cm). As most clearly shown in FIG. 2, the butt end portion 12 of the face tip shingle section 3 overhangs the lower edge of the backing sheet 6, preferably about one inch (2.54 cm), while the rabbeted butt end portion 13 of the face butt shingle section 4 overlies the tip end portion 11 of the face tip shingle section 3. The tip end 14 of the face butt shingle section 4 may be spaced downward from the upper edge of the backing sheet 6 to expose about one inch (2.54 cm) of the upper marginal portion of such sheet. The face layer half-length shingle sections 3 and 4 thus contiguously overlie the backing sheet over most of their area and are bonded to the outer face of the backing sheet with exterior adhesive, such as phenolic or urea formaldehyde resin.

As best seen in FIG. 3, the two courses of face tip shingle sections and butt shingle sections are in edge-to-edge abutment within each face course, but the upper and lower half sections of the same shingle are not in elevational registration. On the contrary, the face tip shingle sections 3 and the face butt shingle sections 4 are arranged along their face courses, or are located in corresponding face courses of other panels, so that the tip shingle sections and the butt shingle sections in general elevational registration are of different widths. Alternatively, corresponding tip and butt sections of a particular shingle can merely be offset lengthwise of the courses. In either case, all joints between face tip shingle sections are preferably out of alignment with joints between face butt shingle sections.

When the panel is completed, most of the area of the face sides of the tip shingle sections 3 in the lower face course is exposed, only a small fraction of the length of the tip shingle sections in the face lower course at their upper portions being covered by the butt portions of the butt shingle sections 4 in the upper face course. The portions of the tip shingle sections 3 in the lower face course adjacent to the butts of the shingle sections 4 in the upper face course are exposed, as shown in FIG. 3.

After the panel is laid up and the components of the upper shingle facing and lower backing sheet layers have been bonded together, it is trimmed to length, typically 8 feet (2.4 m). Each of the panel ends is then routed to form opposite shiplap joint components at opposite ends of the panel as shown in FIGS. 3 and 5. As best shown in FIG. 5, the shiplap joint component is formed at one end of the panel by removing approximately the upper one-half of the backing sheet 6 thickness, and at the other end of the panel by removing approximately the lower one-half of the backing sheet thickness.

In constructing a sidewall or roof no starter course is required. To facilitate assembly of the panel end shiplap joints shown in FIGS. 3 and 5, the panels are applied to a sidewall or roof from left to right. The successive courses are aligned by laying the overhanging butt end portions 12 of the tip shingle sections 3 of one panel over the tip end portions 15 of the butt shingle sections 4 of the next lower panel so that the butt ends of the shingles in course 3 are visible. The lower edge portion of the upper panel backing sheet 6 overlies the upper edge portion of the backing sheet 6 in the next lower panel and abuts the tip ends 14 of the upper shingle sections course of the lower panel. The adjacent edges of the adjacent panel backing sheets overlap as shown in FIG. 4 and the shiplap end joints are overlapped as shown in FIG. 5.

The panels are secured to the sidewall or roof with aluminum or rust-resistant nails n as shown in FIG. 4. The nails are evently spaced adjacent to the butt edge of each course along the lower margin of the panel and along the central portion of the panel as shown in FIG. 4. The nails are spaced apart distances equal to the spacing of the studs with one nail on each side of the shiplap joint as shown in FIG. 5. The nails in the face tip shingle section lower course along the lower margin of a panel penetrate the butt end portion 12 of the face tip shingle sections 3, the backing sheet 6 of that panel, the backing sheet 6 of the next lower panel and a stud s. The nails in the face butt shingle section course along the central portion of the panel penetrate a butt shingle section 4 above its butt end portion 13, the backing sheet 6 of the panel and stud s.

Since the thickness of the butt end portion 12 of each face tip shingle section 3 is substantially the same as the butt end portion 13 of the face butt shingle section 4 remaining after being rabbeted, the face tip shingle section and face butt shingle section courses have identical appearance when the panel is applied to a roof or sidewall. Also, since there is only a minimum overlapping of shingle material between courses and virtually all of the full-length shingle material is utilized as facing, a minimum amount of shingle material is required.

However, since the shingle sections are applied in edge-to-edge abutting relationship backed by the continuous backing sheet 6, and since joints between the courses are rabbeted and the end joints of the panels are of the shiplap type, the paneling resists rain penetration.

Figure 6:
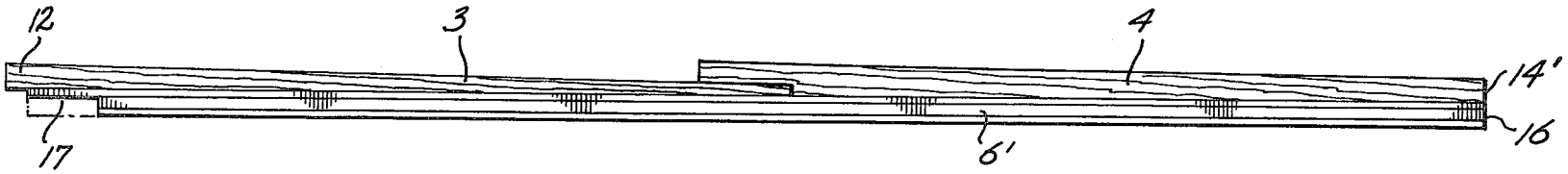
FIG. 6 is a side elevation of a modified shingle panel of the present invention.
Figure 7:
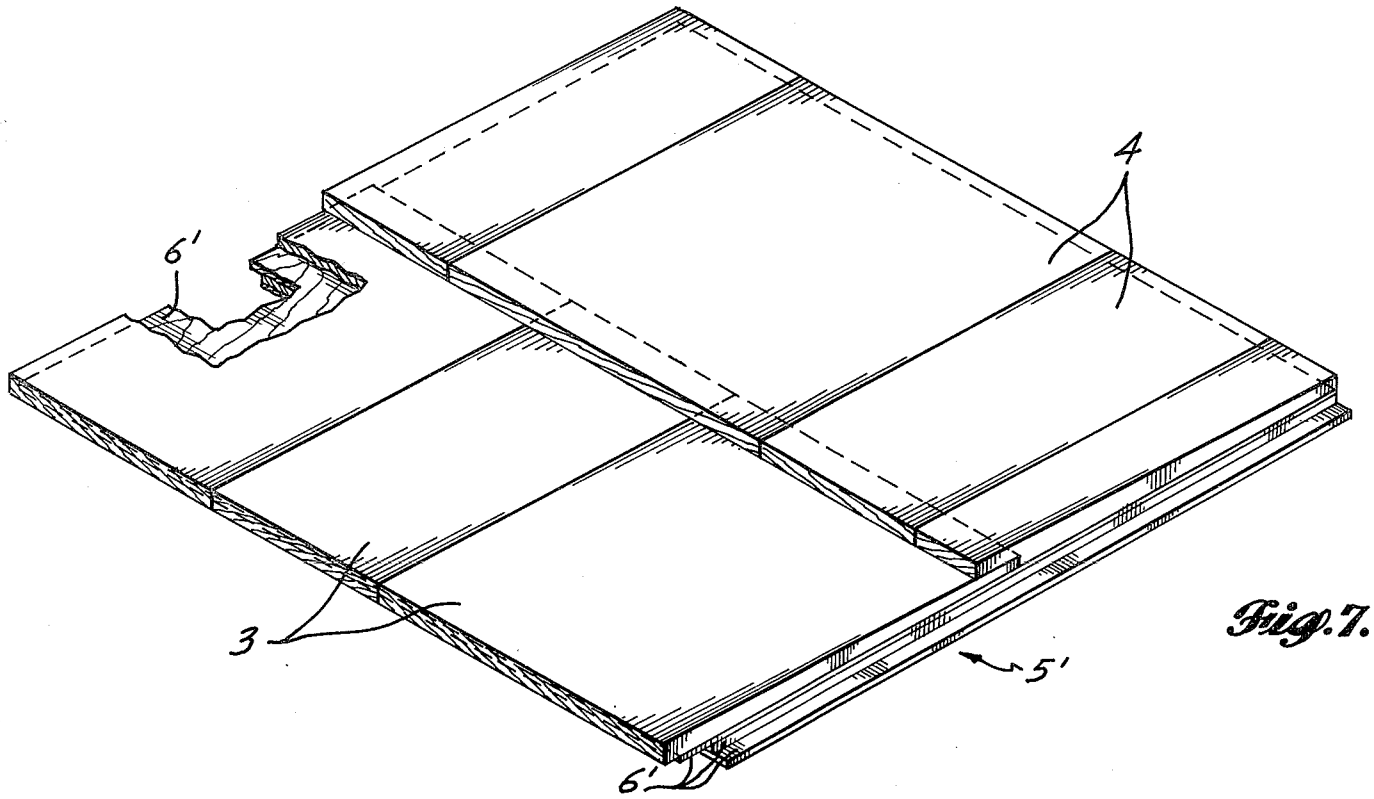
FIG. 7 is a top perspective of the FIG. 6 shingle panel with parts being broken away.
Figure 8:
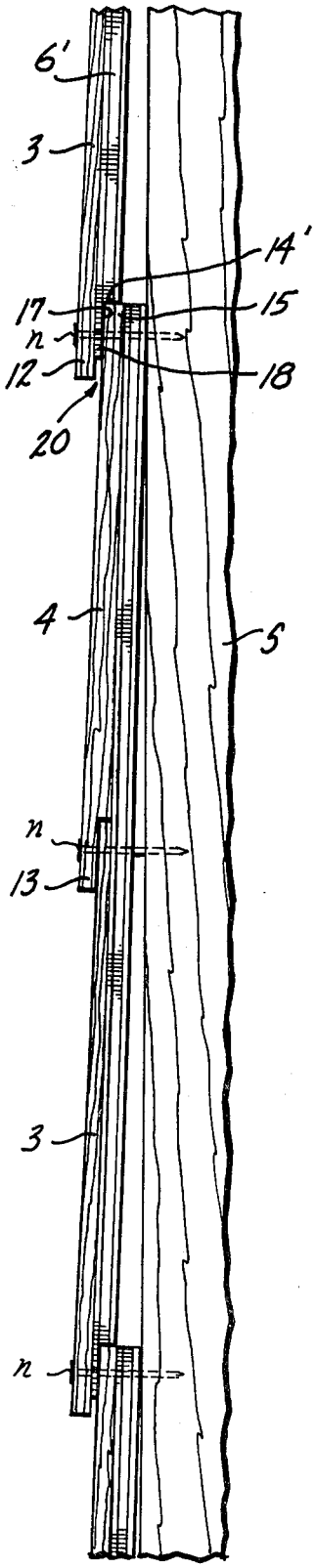
FIG. 8 is a vertical section of panels of the type shown in FIG. 6 applied to a sidewall, parts being broken away.

In a second embodiment of the invention, shown in FIGS. 6 to 8, the lengthwise relationship of each butt shingle section 4 and each tip shingle section 3 in the panel layup is interchanged from the lengthwise relationship of such sections in the full-length shingle of FIG. 1, similar to the panel lay-up shown in FIG. 2. However, the tip end 14' of each face butt shingle section 4 is substantially even with the upper edge 16 of the backing sheet 6' and the butt end portion 12 of each face tip shingle section 3 overhangs the lower edge of the backing sheet 6' but to a lesser extent than the butt end portion of the tip shingle section 3 shown in FIG. 2. In the embodiment shown in FIG. 6, the butt end portion 12 of each face tip shingle section 3 may overhang the lower edge of the backing sheet 6' about ¼ inch (6.35 mm). Therefore, as in the FIG. 2 embodiment, face layer half-length shingle sections 3, 4 contiguously overlie the backing sheet over most of their area and are bonded to the outer face of the backing sheet with exterior adhesive. After the face layer is bonded to the backing sheet, the lower edge portion of the backing sheet adjacent to the butt end portion 12 of each face tip shingle section is routed to form a rabbet 17 beneath the butt margins of the face tip shingle sections. The depth of the rabbet 17 preferably is approximately two-thirds of the thickness of the backing sheet 6' and its width is preferably ¾ inch (19.05 mm).

As best seen in FIG. 7, the two courses of face tip shingle sections and face butt shingle sections are arranged in the shingle panel 5' with the joints between the tip shingle sections 3 out of alignment with the joints between the butt shingle sections 4, similar to the arrangement in the FIG. 3 shingle panel. Also the panel ends are routed to form opposite shiplap joint components at opposite ends of the panel as discussed in connection with the panels of FIGS. 3 and 5.

As shown in FIG. 8, the successive courses of shingle panels are aligned on the sidewall or roof by laying face the butt end portions 12 of the face tip shingle sections 3 and the projecting rabbeted portion 18 of the backing sheet 6' over the tip end portions 15 of the face butt shingle sections 4 of the next lower panel so that the lower edge of the backing sheet 6' of the upper panel abuts the upper ends of the face butt shingle sections in the lower panel to locate the upper panel properly relative to the lower panel. Because of the resulting overlapping relationship of the rabbeted lower margin of the upper panel backing sheet and the upper margin of the lower panel, including the upper edge portion of its backing sheet 6, any rain which might penetrate between the joints of the face tip shingle sections 3 of the upper panel cannot seep between the tip ends 14 of the face butt shingle sections of the next lower panel and the lower edge of the backing sheet 6' of the adjacent higher panel. Any rain which penetrates the joint between the face tip shingle sections will be directed by the overlapping portion 18 of the backing sheet 6' onto the exposed surface of the face butt shingle sections of the next lower course of panels.

The panels are secured to the sidewall or roof with aluminum or rust-resistant nails n as shown in FIG. 8. The nails in the face tip shingle section course along the lower margin of the panel penetrate the butt end portion 12 of tip shingle section 3, the rabbeted portion 18 of backing sheet 6' of that panel, the tip end portion 15 of the butt shingle section 4 of the next lower panel, the upper edge portion of the backing sheet of such next lower panel and a stud s. The nails in the butt shingle section course along the central portion of the panel penetrate the butt end portion 13 of the butt shingle section 4, the tip end portion of the tip shingle section 3, the backing sheet 6' of the panel and stud s.

Since the shingle sections are applied in edge-to-edge abutting relationship backed by the continuous backing sheet 6', and since the joints between the courses are rabbeted and the end joints of the panels are the shiplap type, the paneling resists rain penetration. However, since the butt end portions 12 of the face tip shingle sections 3 overhang the rabbeted portions 18 of the backing sheets 6', a shadow line 20 is created at the panel-to-panel joints, whereas no shadow line is created by the butt end portions 13 of the face butt shingle sections 4. While this nonuniform appearance is not pronounced, it may be avoided by the shingle panel embodiments shown in FIG. 9 and FIGS. 10 and 11.

Figure 9:
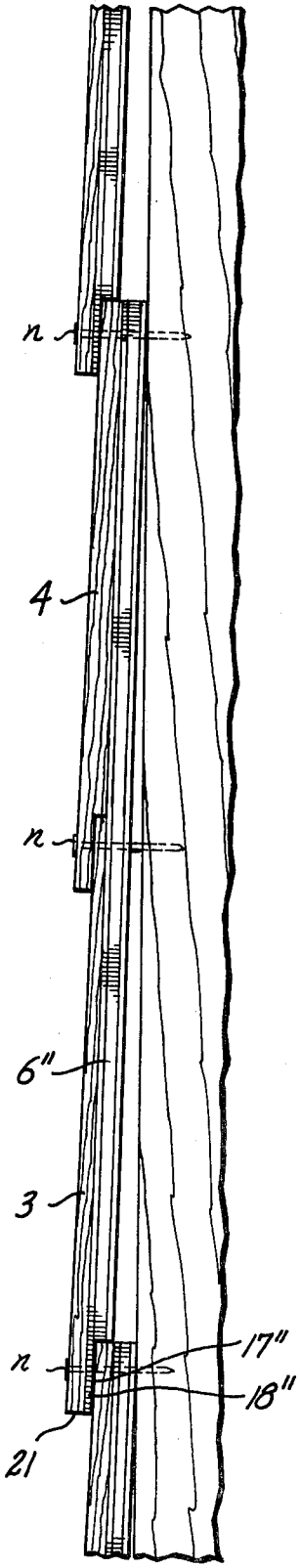
FIG. 9 is a vertical section of another embodiment of panels applied to a sidewall, parts being broken away.

The shingle panel embodiment shown in FIG. 9 is constructed and applied to a sidewall or roof in a manner similar to that used for the embodiment shown in FIGS. 6 to 8 with the exception that the butt ends 21 of the face tip shingle sections 3 are substantially even with the lower edge of the rabbeted portion 18" of the backing sheet 6". The shingle panel is layed up with the butt ends of the face tip shingle sections and the lower edge of the backing sheet even, or the lower end portion of the shingle panel may be trimmed before or after the rabbet 17" is routed. Preferably the depth of the rabbet 17" is approximately two-thirds of the thickness of the backing sheet 6" and the width is preferably about 1 inch (2.54 cm). When the panels are applied to a sidewall or roof as shown in FIG. 9, a siding or roof of uniform appearance with no shadow lines results.

Figure 10:
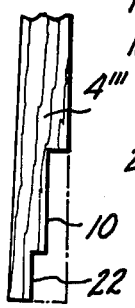
FIG. 10 is a side elevation of the butt margin of a butt shingle section similar to the butt shingle section shown in FIG. 1 which has been routed to form a stepped rabbet.
Figure 11:
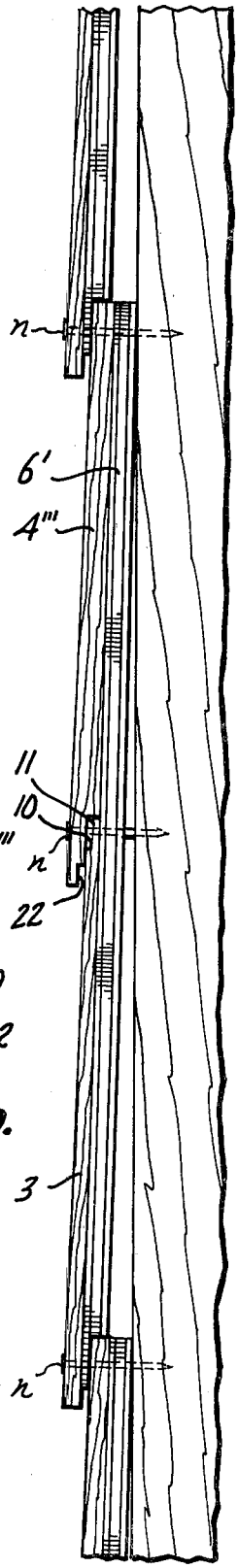
FIG. 11 is a vertical section of panels with the stepped rabbeted butt end portions shown in FIG. 10 applied to a sidewall, parts being broken away.

To construct a sidewall or roof of uniform appearance with shadow lines, the butt shingle sections are modified by routing a second rabbet in the lower or marginal portion of the rabbet 10 as shown in FIG. 10, forming a stepped rabbet. Preferably the depth of the second rabbet 22 is approximately one-third the depth of the backing sheet 6' and the width is preferably about ¼ inch (6.35 mm). The shingle panels are then constructed and applied as described with reference to the shingle panels of FIGS. 6 through 8. As shown in FIG. 11, face tip shingle sections 3 and face butt shingle sections ''' are laid up on the backing sheet 6' with the tip end portion 11 of each face tip shingle section 3 received in the rabbet 10 and the second rabbet 22 creates a shadow line similar to the shadow line created at the joints between upper and lower shingle panels.

We claim:

1. The process of making wood shingle panels which comprises severing standard fulllength shingles transversely of their lengths between their tip and butt ends and thereby making first tip shingle sections and second butt shingle sections, and bonding in contiguous relationship to a substantially planar surface of a backing sheet having generally parallel opposite edges and a width nearly as great as the combined lengths of the first tip shingle sections and the second butt shingle sections a face layer including a face lower course of such first shingle sections in edge-to-edge relationship having most of the area of their face sides exposed and their butts adjacent and generally parallel to one of such edges of the backing sheet when construction of the panel is completed and a face upper course of such second shingle sections in edge-to-edge relationship having all of their face sides exposed, their tips adjacent and generally parallel to the opposite one of such edges of the backing sheet and their butt end portions disposed adjacent to and overlapping the tip end portions of the first shingle sections in the face lower course between the generally parallel opposite edges of the backing sheet for only a small fraction of the length of the first tip shingle sections forming the face lower course with those portions of the outer surface of the first tip shingle sections forming the face lower course being exposed adjacent to the butts of the second butt shingle sections forming the face upper course when the panel is finished and with no face course of shingles or shingle sections interposed between such face lower course and such face upper course.

2. The process defined in claim 1, including rabbeting the margin of the backing sheet beneath the butt end portions of the first shingle sections to enable such rabbeted portion to overlie the margin of another similar shingle panel adjacent to the tip portions of second shingle sections secured thereon.

3. The process defined in claim 2, including securing the first shingle sections with their butt end portions overhanging the rabbeted edge of the backing sheet to form a shadow line.

4. The process defined in claim 1, including securing the second shingle sections with their tip ends spaced from such opposite edge of the backing sheet to expose a marginal portion of the backing sheet.

5. The process of making wood shingle panels which comprises severing standard full-length shingles transversely of their lengths between their tip and butt ends and thereby making first tip shingle sections and second butt shingle sections, routing the butt end portion of each second shingle section to form a stepped rabbet deeper at the marginal portion of the rabbet and bonding in contiguous relationship to a substantially planar surface of a backing sheet having generally parallel opposite edges and a width nearly as great as the combined lengths of the first tip shingle sections and the second butt shingle sections a face layer including a face lower course of such first shingle sections in edge-to-edge relationship having most of the area of their face sides exposed and their butts adjacent and generally parallel to one of such edges of the backing sheet when construction of the panel is completed and a face upper course of such second shingle sections in edge-to-edge relationship having all of their face sides exposed and their tips adjacent and generally parallel to the opposite one of such edges of the backing sheet, and overlapping such rabbeted butt end portions of the second shingle sections over the tip end portions of the first shingle sections in the face lower course between the generally parallel opposite edges of the backing sheet so that the tip end portions of the first shingle sections are received in the shallower portions of the stepped rabbets for only a small fraction of the length of the first tip shingle sections forming the face lower course with those portions of the outer surface of the first tip shingle sections forming the face lower course being exposed adjacent to the butts of the second butt shingle sections forming the face upper course when the panel is finished and with no face course of shingles or shingle sections interposed between such face lower course and such face upper course and the deeper portions of the stepped rabbets of the second shingle sections being spaced from the portions of the first shingle sections therebeneath to form a shadow line.

6. The process defined in claim 5, including rabbeting the margin of the backing sheet beneath the butt end portions of the first shingle sections and securing the first shingle sections with their butt end portions overhanging the rabbeted edge of the backing sheet.

7. The process of making wood shingle panels which comprises severing standard full-length shingles transversely of their lengths between their tip and butt ends and thereby making tip first shingle sections and butt second shingle sections, and securing to an elongated backing sheet a face layer including a face upper course of such first shingle sections in edge-to-edge relationship adjacent to a first longitudinal edge of the backing sheet with their butt ends overhanging the first edge of the backing sheet and a row of such second shingle sections in edge-to-edge relationship adjacent to the second longitudinal edge of the backing sheet, the butt portions of the second shingle sections being rabbeted and overlying the tip portions of the first shingle sections secured to the backing sheet.

8. The process defined in claim 7, including adhesively bonding the first shingle sections and the second shingle sections to a substantially planar surface of the backing sheet in contiguous relationship over the major portion of each shingle section.

9. The process defined in claim 7, in which the butt portions of the second shingle sections are rabbeted to such an extent that the butt ends of the second shingle sections have a thickness approximately equal to the thickness of the butt ends of the first shingle sections.

10. A wood shingle panel comprising a backing sheet having opposite generally parallel edges and a substantially planar surface, and a face layer contiguously bonded to said backing sheet planar surface and including a face lower course of longitudinally tapered first shingle sections in edge-to-edge relationship, having thinner tip end portions and thicker butt end portions and disposed with their butt ends adjacent to one of said edges of said backing sheet and with their tip ends located generally centrally between said generally parallel edges of said backing sheet, and a face upper course of longitudinally tapered second shingle sections in edge-to-edge relationship, having thinner tip end portions and thicker butt end portions and an average thickness substantially greater than the average thickness of said tapered first shingle sections and disposed with their tip ends adjacent to the other of said edges of said backing sheet, the butt end portions of said second shingle sections being rabbeted and the tip end portions of said first shingle sections in said face lower course being received in the rabbet for only a small fraction of the length of said first shingle sections and thereby leaving most of the area of the face sides of said first shingle sections exposed including the portions adjacent to the butts of said second shingle sections forming said face upper course, with no face course of shingles or shingle sections interposed between said face lower and upper courses of shingle sections, and the width of said backing sheet between its opposite parallel edges being nearly as great as the combined lengths of said first shingle sections and said second shingle sections.

11. A wood shingle panel comprising a backing sheet having opposite generally parallel edges and a substantially planar surface, and a face layer contiguously bonded to said backing sheet planar surface and including a face lower course of longitudinally tapered first shingle sections in edge-to-edge relationship, having thinner tip end portions and thicker butt end portions and disposed with their butt ends adjacent to one of said edges of said backing sheet and with their tip ends located generally centrally between said generally parallel edges of said backing sheet, and a face upper course of longitudinally tapered second shingle sections in edge-to-edge relationship, having thinner tip end portions and thicker butt end portions and an average thickness substantially greater than the average thickness of said tapered first shingle sections and disposed with their tip ends adjacent to the other of said edges of said backing sheet, the butt end portions of said second shingle sections being stepped to form a deeper marginal rabbet portion and a shallower rabbet portion, and the tip end portions of said first shingle sections in said face lower course being received in the shallower rabbet portion farthest from said second shingle section's rabbeted margin for only a small fraction of the length of said first shingle sections and thereby leaving most of the area of the face sides of said first shingle sections exposed including the portions adjacent to the butts of said second shingle sections forming said face upper course so that the deeper rabbet portion is spaced from the portion of said first shingle sections therebeneath to form a shadow line, with no face course of shingles or shingle sections interposed between said face lower and upper courses of shingle sections, and the width of said backing sheet between its opposite parallel edges being nearly as great as the combined lengths of said first shingle sections and said second shingle sections.

12. A wood shingle panel comprising a backing sheet having opposite generally parallel edges and a substantially planar surface, and a face layer contiguously bonded to said backing sheet planar surface and including a face lower course of longitudinally tapered first shingle sections in edge-to-edge relationship, having thinner tip end portions and thicker butt end portions and disposed with their butt ends adjacent to one of said edges of said backing sheet and with their tip ends located generally centrally between said generally parallel edges of said backing sheet, and a face upper course of longitudinally tapered second shingle sections in edge-to-edge relationship, having thinner tip end portions and thicker butt end portions and an average thickness substantially greater than the average thickness of said tapered first shingle sections and disposed with their tip ends adjacent to the other of said edges of said backing sheet and their butt end portions adjacent to and with overlapping the tip end portions of said first shingle sections in said face lower course for only a small fraction of the length of said first shingle sections and thereby leaving most of the area of the face sides of said first shingle sections exposed including the portions adjacent to the butts of said second shingle sections forming said face upper course, with no face course of shingles or shingle sections interposed between said face lower and upper courses of shingle sections, and the width of said backing sheet between its opposite parallel edges being nearly as great as the combined lengths of said first shingle sections and said second shingle sections.

13. The panel defined in claim 12 in which the second shingle sections and the first shingle sections are adhesively bonded to the backing sheet planar surface in contiguous relationship over the major portion of each shingle section.

14. The panel defined in claim 12, in which the butt end portions of the first shingle sections overhang the adjacent edge of the backing sheet.

15. The panel defined in claim 12, in which the tip ends nd second shingle sections are spaced from the adjacent edge of the backing sheet to expose a marginal portion of the backing sheet.

16. The panel defined in claim 13, in which the butt ends of the first shingle sections are of a thickness substantially equal to the thickness of the tip ends of the second shingle sections.

17. The panel defined in claim 12, in which the edge portion of the backing sheet adjacent to the butt end portions of the first shingle sections is rabbeted.

18. A wood shingle panel comprising a backing sheet having opposite generally parallel edges and a substantially planar surface, and a face layer contiguously bonded to said backing sheet planar surface and including a face lower course of longitudinally tapered first shingle sections in edge-to-edge relationship, having thinner tip end portions and thicker butt end portions and disposed with their butt ends adjacent to one of said edge of said backing sheet and with their tip ends located generally centrally between said generally parallel edges of said backing sheet, and a face upper course of longitudinally tapered second shingle sections in edge-to-edge relationship, having thinner tip end portions and thicker butt end portions and an average thickness substantially greater than the avarage thickness of said tapered first shingle sections and disposed with their tip ends adjacent to the other of said edges of said backing sheet and their butt end portions adjacent to and overlapping the tip end portions of said first shingle sections in said face lower course for only a small fraction of the length of said first shingle sections and thereby leaving most of the area of the face sides of said first shingle sections exposed including the portions adjacent to the butts of said second shingle sections forming said face upper course, with no face course of shingles or shingle sections interposed between said face lower and upper courses of shingle sections, and the width of said backing sheet between its opposite parallel edges being nearly as great as the combined lengths of said first shingle sections and said second shingle sections, the edge portion of said backing sheet adjacent to the butt end portions of said first shingle sections being rabbeted and the butt end portions of said first shingle sections overhang the rabbeted edge portion of said backing sheet.

* * * * *

UNITED STATES PATENT AND TRADEMARK OFFICE

CERTIFICATE OF CORRECTION

PATENT NO. : 4,459,788

DATED : July 17, 1984

INVENTOR(S) : Joe L. Bockwinkel and Willis G. Pehl

It is certified that error appears in the above-identified patent and that said Letters Patent are hereby corrected as shown below:

Column 8, line 14, cancel "upper" and insert ...lower...; line 18, cancel "row" and insert ...face upper course....

Column 9, line 50, before "their" insert ...with...; line 51, cancel "with".

Column 10, line 5, after "12" insert a comma; line 17, cancel "13" and insert ...12...; line 32, cancel "edge" and insert ...edges....

Signed and Sealed this

*Twenty-second* Day of *January 1985*

[SEAL]

*Attest:*

DONALD J. QUIGG

*Attesting Officer* *Acting Commissioner of Patents and Trademarks*